United States Patent [19]

Ono et al.

[11] Patent Number: 4,587,210

[45] Date of Patent: May 6, 1986

[54] COLOR PHOTOGRAPHIC SILVER HALIDE LIGHT-SENSITIVE MATERIAL CONSISTING OF A SPECIFIED HYDROQUINONE DERIVATIVE

[75] Inventors: Michio Ono; Masakazu Morigaki; Takayoshi Kamio; Kozo Aoki; Kazuhiko Furuya, all of Kanagawa, Japan

[73] Assignee: Fuji Photo Film Co., Ltd., Kanagawa, Japan

[21] Appl. No.: 595,195

[22] Filed: Mar. 30, 1984

[30] Foreign Application Priority Data

Mar. 31, 1983 [JP] Japan ..... 58-55699

[51] Int. Cl.[4] ..... G03C 1/08; G03C 7/26; G03C 7/32

[52] U.S. Cl. ..... 430/555; 430/485; 430/551; 430/554; 430/558

[58] Field of Search ..... 430/551, 554, 555, 558, 430/485

[56] References Cited

U.S. PATENT DOCUMENTS

| | | | |
|---|---|---|---|
| 3,930,866 | 1/1976 | Oishi et al. | 430/558 X |
| 3,935,016 | 1/1976 | Nishimura et al. | 430/543 X |
| 3,982,944 | 9/1976 | Ohi et al. | 430/551 X |
| 4,138,259 | 2/1979 | Adachi et al. | 430/554 X |
| 4,388,404 | 6/1983 | Moricaki et al. | 430/558 X |
| 4,429,031 | 1/1984 | Tsubota et al. | 430/485 X |

FOREIGN PATENT DOCUMENTS

| | | | |
|---|---|---|---|
| 0009528 | 1/1978 | Japan | 430/551 |

*Primary Examiner*—John E. Kittle
*Assistant Examiner*—Mukund J. Shah
*Attorney, Agent, or Firm*—Sughrue, Mion, Zinn, Macpeak, and Seas

[57] ABSTRACT

A color photographic silver halide light-sensitive material is described, characterized by containing at least one of the compounds represented by the general formula (I) and their precursors.

Formula (I)

wherein R represents $$-\overset{R_1}{\underset{R_2}{C}}-C_nH_{2n}-R_3$$

(wherein $R_1$ and $R_2$ are each a hydrogen atom or an alkyl group and may combine with $R_3$ to form a ring having 5 to 10 carbon atoms, provided that $R_1$ and $R_2$ are not hydrogen atoms at the same time, $R_3$ is a substituted or unsubstituted aryl group, and n is an integer of 1 to 4), and R' has 1 to 20 carbon atoms and represents a substituted or unsubstituted alkyl group, a substituted or unsubstituted cycloalkyl group, a substituted or unsubstituted aryl group, or a substituent defined by R as defined above). This light-sensitive material provides color images which are stabilized, i.e., freed of fading and the discoloration of the white ground.

14 Claims, No Drawings

COLOR PHOTOGRAPHIC SILVER HALIDE LIGHT-SENSITIVE MATERIAL CONSISTING OF A SPECIFIED HYDROQUINONE DERIVATIVE

FIELD OF THE INVENTION

The present invention relates to a color photographic silver halide light-sensitive material. More particularly, the present invention is concerned with an improved color photographic silver halide light-sensitive material in which dye images formed by applying photographic processing are stabilized, i.e., prevented from fading, and also discoloration of uncolored areas (white background) is prevented.

BACKGROUND OF THE INVENTION

A color photographic silver halide light-sensitive material (hereinafter sometimes referred to merely as a "light-sensitive material") is generally prepared by providing silver halide emulsions with a coupler dispersed therein on a suitable support; couplers forming cyan, magenta and yellow dyes on coupling with an oxidation product of a color developing agent are dispersed in red-, green- and blue-sensitive silver halide emulsions layers, respectively, and provided in a suitable order in the form of multilayered structure.

The thus prepared light-sensitive material is exposed to light and, thereafter, is subjected to a series of treatment such as color development, bleaching, fixation, and stabilization to form ultimate color images.

Film materials bearing such color images are stored as records for long periods of time, or exhibited. These color images, however, are not always stable against light, heat and moisture. When the film material is exposed to light for a long period of time or is stored under the conditions of high temperature and high moisture, fading and discoloration of dye images and furthermore, discoloration of the white background usually occur, resulting in a reduction of image quality.

Such fading or discoloration of images is a disadvantage which can be said to be vital to recording materials. Thus, in order to eliminate the disadvantage, incorporation of additives or stabilizers has been proposed. Typical examples of additives which have been proposed for that purpose include hydroquinone derivatives, such as 2,5-di-tert-butylhydroquinone; phenol compounds, such as 2,6-di-tert-butyl-p-cresol, 4,4'-methylenebis(2,6-di-tert-butylphenol), 2,2'-methylenebis(4-ethyl-6-tert-butylphenol), and 4,4'-isopropylidenediphenol; tocopherol, and p-alkoxyphenol compounds. Specifically, hydroquinone derivatives are described in, for example, U.S. Pat. Nos. 2,360,290, 2,418,613, 2,675,314, 2,710,197, 2,704,713, 2,728,659, 2,732,300, 2,735,765, 2,710,801, 2,816,028, British Pat. No. 1,363,921, and Japanese Patent Publication No. 40819/81 corresponding to U.S. Pat. No. 4,138,259.

Hydroquinone derivatives are also used as anti-color-foggants (anti-color contamination agent), as described in, for example, U.S. Pat. Nos. 2,728,659, 3,700,453, West German Patent Application Laid-Open No. 2,149,789, U.S. Pat. Nos. 2,728,659, 3,935,016, 2,732,300 (corresponding to British Pat. No. 752,147), British Pat. Nos. 752,146, 1,086,208, Japanese Patent Publication Nos. 21249/75, 40818/81 corresponding to British Pat. No. 1,571,445, and 40816/81, and Japanese Patent Application (OPI) No. 69141/80 (The term "OPI" as used herein refers to a "published unexamined Japanese Patent Application").

Conventional additives, however, which have been proposed to eliminate the above-described disadvantage, are not suitable for practical use; although they are effective to prevent the fading or discoloration of dye images, the effect is not sufficiently high, or problems such as deterioration of hue, formation of fog, poor dispersion, and formation of crystals are undesirably involved. Thus it can be said that a dye image stabilizer sufficiently satisfactory for practical use has not been proposed yet.

SUMMARY OF THE INVENTION

An object of the invention is to provide a color photographic silver halide light-sensitive material which produces stable color images, i.e., color images which are prevented from fading or discoloring.

Another object of the invention is to provide a color image stabilizer which is able to sufficiently prevent the fading or discoloration of color images without causing problems such as deterioration of hue and formation of fog.

It has been found that the objects are attained by incorporating at least one of the compounds represented by the general formula (I) as described hereinafter and their precursors into a photographic light-sensitive material.

The present invention relates to a color photographic silver halide light-sensitive material characterized by containing at least one compound represented by the general formula (I) as described below or its precursor.

Formula (I)

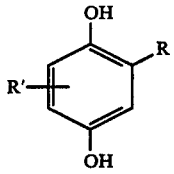

wherein R represents

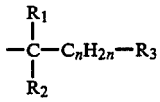

(wherein $R_1$ and $R_2$ are each a hydrogen atom or an alkyl group and may combine with $R_3$ to form a ring having 5 to 10 carbon atoms, provided that $R_1$ and $R_2$ are not hydrogen atoms at the same time, $R_3$ is a substituted or unsubstituted aryl group, and n is an integer of 1 to 4), and R' has 1 to 20 carbon atoms and represents a substituted or unsubstituted alkyl group, a substituted or unsubstituted cycloalkyl group, a substituted or unsubstituted aryl group, or R as defined above).

DETAILED DESCRIPTION OF THE INVENTION

The term "precursor" is used herein to mean the compounds which release the hydroquinone compounds of the general formula (I) through, for example, hydrolysis. Examples are compounds resulting from replacement of the hydrogen atom of one or both of the hydroxyl groups of the hydroquinone compounds by an acyl group. The term "acyl group" as used herein is used in a broad sense and includes the groups represented by the following formulas:

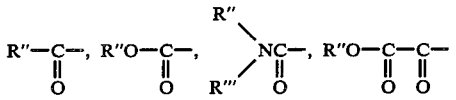

(wherein R'' and R''' each represent an alkyl group, an aryl group, etc.).

The compounds of the general formula (I) as used herein are hereinafter described in detail.

In the general formula (I), R is

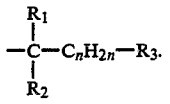

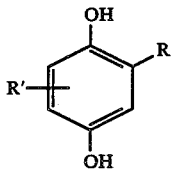

(I)

R' is an alkyl group, a cycloalkyl group or an aryl group, which all contain 20 carbon atoms or less and may be substituted or unsubstituted, or R. Substituents for the alkyl, cycloalkyl and aryl groups include a halogen atom, an aryl group having 6 to 20 carbon atoms, an aralkyl group having 7 to 20 carbon atoms, an alkoxyl group having 1 to 16 carbon atoms, an aryloxy group having 6 to 18 carbon atoms, a carboxyl group, an alkoxycarbonyl group having 2 to 17 carbon atoms, an acyloxy group having 1 to 18 carbon atoms, a carbamoyl group having 1 to 19 carbon atoms, an acylamino group having 1 to 18 carbon atoms, a sulfonyl group having 1 to 18 carbon atoms, a sulfamoyl group having 1 to 18 carbon atoms, an amide group having 2 to 18 carbon atoms, a hydroxy group, a cyano group, and an ether group having 2 to 20 carbon atoms.

$R_1$ and $R_2$ are each a hydrogen atom or an alkyl group, specifically an alkyl group having 1 to 5 carbon atoms, and may combine with $R_3$ to form a ring having from 5 to 10 carbon atoms, provided that $R_1$ and $R_2$ are not hydrogen atoms at the same time.

$R_3$ is a substituted or unsubstituted aryl group, wherein a total carbon numbers is 6 to 20, such as a naphthyl group and a phenyl group. Substituents for the aryl group of $R^3$ are the same as those represented by the following $R^4$.

n is an integer of 1 to 4.

Of the hydroquinone compounds of the general formula (I), the compounds represented by the general formula (II) as described hereinafter or their precursors are preferred in view of the effects produced thereby.

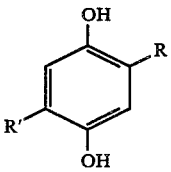

Formula (II)

In the general formula (II), R represents

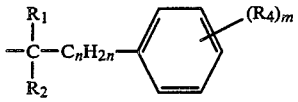

R', $R_1$ and $R_2$ are as defined for the general formula (I).

$R_4$ is a hydrogen atom, or an alkyl group (e.g., a methyl group, a tert-butyl group, and a tert-octyl group), an aryl group, an alkyloxy group (e.g., a methoxy group and an ethoxy group), an aryloxy group, a carbamoyl group, an acylamino group, an acyl group, a carbonyloxy group, a sulfamoyl group, a sulfonyl group, or a sulfonylamino group, these groups having up to 8 carbon atoms, or a hydroxyl group, a halogen atom, or a cyano group. a sulfonyl group, or a sulfonylamino group, or a hydroxyl group, a halogen atom, or a cyano group.

m is an integer of 1 to 4, and when m is not less than 2, $R_4$ may be the same or different.

n is an integer of 1 to 4.

More preferred among the hydroquinone compounds of the general formula (II) are the commpounds represented by the general formula (III) as described hereinafter or their precursors in view of the effects produced thereby.

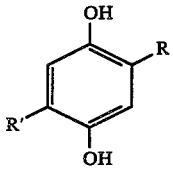

Formula (III)

In the general formula (III), R is

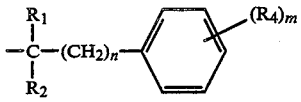

R' is as defined for the general formula (I), and $R_4$ and m are as defined for the general formula (II).

$R_1$ and $R_2$ are each an alkyl group containing from 1 to 5 carbon atoms (e.g., a methyl group, an ethyl group, an isobutyl group, and a neopentyl group), or may combine with a group:

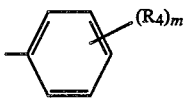

to form a ring containing from 5 to 10 carbon atoms.

n is an integer of from 1 to 4.

Especially preferred among the hydroquinone compounds of the general formula (III) are the compounds represented by the general formula (IV) as described hereinafter or their precursors in view of the effects produced thereby.

Formula (IV)

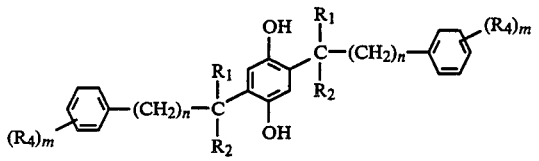

In the general formula (IV), $R_1$ and $R_2$ are as defined for the general formula (III), and $R_4$ and m are as defined for the general formula (II).

n is an integer of 2 or 3.

In the general formulas (I) to (IV), it is particularly preferred that $R_1$ and $R_2$ be both alkyl groups (e.g., methyl groups).

Representative examples of the compounds represented by the general formula (I) are shown below, although the present invention is not limited thereto.

(1)

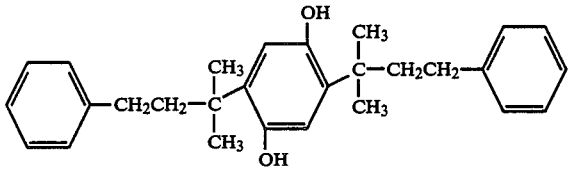

(2)

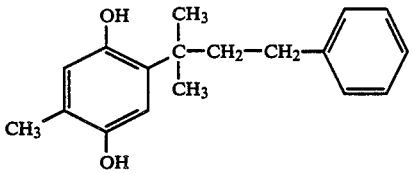

(3)

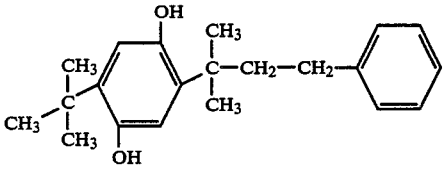

(4)

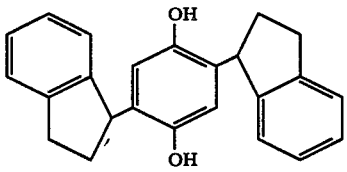

(5)

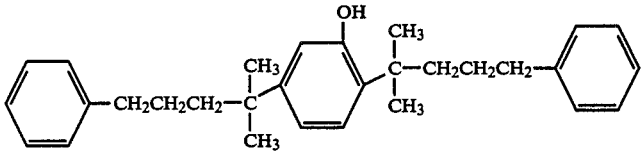

(6)

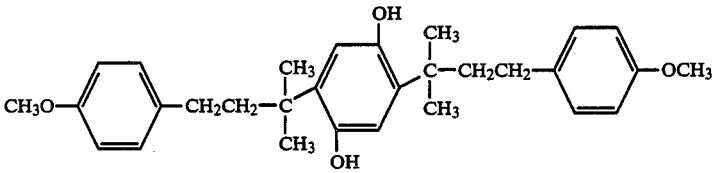

(7)

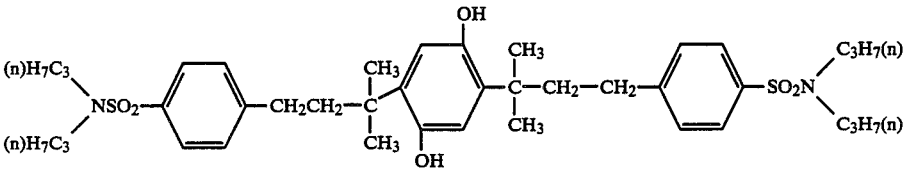

(8)

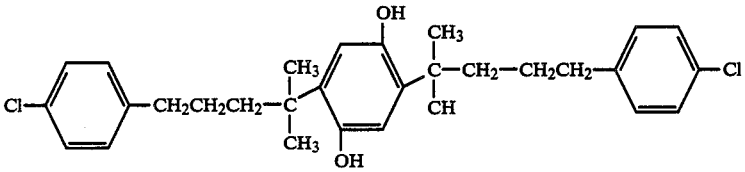

(9)

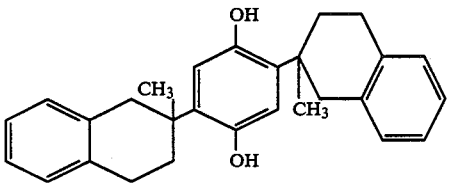

-continued

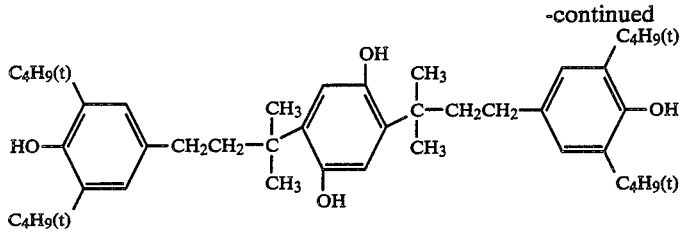

(10)

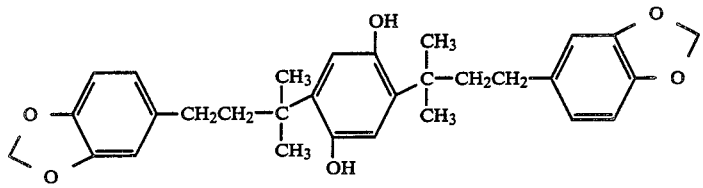

(11)

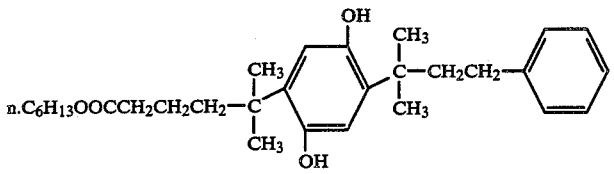

(12)

Of the above Compounds (1) to (12), Compounds (1), (5), (6), (7), (8), (10), (11), (12) are most preferable.

The compounds of the present invention can be prepared by reacting hydroquinone compounds with aryl group-containing alkylating agents (e.g., olefinic compounds and sec- or tert-alcohols) in the presence of an acid catalyst. Typical preparation examples are shown below.

PREPARATION EXAMPLE 1

Synthesis of Compound (1)

Magnesium flakes (14.6 g) were added to 150 ml of ether, and on adding thereto a small amount of a solution of 93 g of 1-bromo-2-phenylethane in 50 ml of ether in a stream of nitrogen while stirring, the reaction started and the ether began to reflux. The remaining 1-bromo-2-phenylethane/ether solution was added dropwise over about 30 minutes. The mixture was then stirred at room temperature for 1 hour to form a Grignard reagent.

Acetone (43.5 g) was added dropwise to the above-prepared Grignard reagent over about 20 minutes while stirring, and the mixture was stirred for additional 1 hour. Subsequently the reaction mixture was cooled with ice and, after gradual addition of 100 ml of water, was neutralized with 220 ml of 6N hydrochloric acid. The ether phase was washed with water, dried over Glauber's salt, and distilled under reduced pressure, whereupon 78 g of 2-methyl-2-hydroxy-4-phenylbutane (liquid) was obtained.

A mixture of 21 g of hydroquinone and 15 ml of concentrated sulfuric acid was dispersed in 20 ml of ethyl acetate, and 78 g of 2-methyl-2-hydroxy-4-phenylbutane as prepared above was added dropwise to the dispersion over about 1 hour in a stream of nitrogen while maintaining the temperature at 40°-50° C. and stirring. The reaction mixture was further stirred at 50° C. for 4 hours and, thereafter, the reaction liquid was poured into ice water and extracted with 200 ml of ethyl acetate. The organic phase was washed with water, dried over Glauber's salt, and concentrated under reduced pressure. Then 150 ml of hexane was added to the residue as obtained above, and on cooling the mixture with ice, crystals precipitated. The crystals precipitated were collected by filtration, whereupon there was obtained 40 g of Compound (1), m.p., 116°-118° C.

Elemental analysis: Calculated for $C_{28}H_{34}O_2$; C, 83.54; H, 8.51. Found; C, 83.40; H, 8.55.

PREPARATION EXAMPLE 2

Synthesis of Compound (4)

A mixture of 11 g of hydroquinone, 29 g of indene, and 15 ml of methanol was prepared, and 8 ml of concentrated sulfuric acid was added dropwise with stirring at a temperature not exceeding 50° C. The mixture was further reacted at 40°-50° C. for 4 hours, and water was then poured thereto. The resulting mixture was extracted with 200 ml of ethyl acetate, washed with water, dried over Glauber's salt, and then concentrated under reduced pressure. Then 80 ml of acetonitrile was added to the residue as obtained above, and on cooling the mixture with ice, crystals precipitated. These crystals were collected by filtration, whereupon there was obtained 15 g of Compound (4), m.p., 68°-73° C.

Elemental analysis: Calculated for $C_{24}H_{22}O_2$; C, 84.18; H, 6.48. Found: C, 82.23; H, 6.44.

Although the amount of the compound of the present invention being added varies with the type of the coupler to be used in combination therewith, it is usually from 0.5 to 200% by weight, preferably from 2 to 150% by weight based on the weight of the coupler. If the amount of the compound added is less than 0.5% by weight, the effect of prevention of fading or coloration of the white ground is so small that the ultimate light-sensitive material is not suitable for practical use. On the other hand, if the compound of the present invention is added in excess amounts, development may be prevented from proceeding smoothly, resulting in a decrease in color density. Further, the amount of the compound of the present invention being added based on per mole of silver halide is $1\times10^{-5}$ to 1 mole most preferably $1\times10^{-3}$ to $5\times10^{-1}$ mole.

The compounds of the general formula (I) that are used in the present invention are included in a silver halide emulsion layer containing coupler, and/or an auxiliary layer such as an intermediate layer, preferably in a silver halide emulsion layer containing magenta coupler.

The amount of the couplers used in the emulsion layer is $2\times10^{-3}$ to $5\times10^{-1}$ mole, preferably $1\times10^{-2}$ to $5\times10^{-1}$ mole per mole of silver halide.

The compounds of the general formula (I) that are used in the present invention are effective particularly to prevent fading of magenta color images and also to prevent yellowish discoloration of the white background.

As magenta couplers, 5-pyrazolone-based compounds are mainly used. In addition, imidazolone-based compounds, cyanoacetyl compounds, and pyrazolotriazole-based compounds are used. Representative examples are described in, for example, U.S. Pat. Nos. 2,439,098, 2,600,788, 3,062,653, 3,558,319, British Pat. No. 956,261, U.S. Pat. Nos. 3,582,322, 3,615,506, 3,519,429, 3,311,476, 3,419,391, 3,935,015, West German Patent Application (OLS) No. 2,424,467, German Pat. No. 1,810,464, Japanese Patent Publication No. 2016/69, West German Patent Application (OLS) No. 2,418,959, U.S. Pat. No. 2,983,608, German Pat. No. 2,532,225, 2,536,191, Japanese Patent Application (OPI) No. 16924/76, and U.S. Pat. Nos. 3,935,016, 4,254,216.

Of the magenta couplers which are used in the present invention, the compounds represented by the general formulas (V), (VI), (VII) and (VIII) as described below provide superior results.

Formula (V)

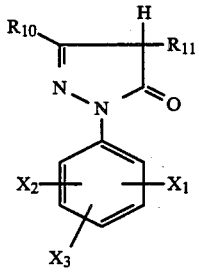

wherein $R_{10}$ is an anilino group, an acylamino group, or a ureido group, $X_1$, $X_2$ and $X_3$ are each a hydrogen atom, an alkyl group, a halogen atom, an alkoxyl group, an aryloxy group, an acylamino group, a carbamoyl group, a sulfamoyl group, a sulfonyl group, or a cyano group, and may be the same or different, and $R_{11}$ is a hydrogen atom or a group capable of being released through a coupling reaction with an oxidized aromatic primary amino color developer.

Formula (VI)

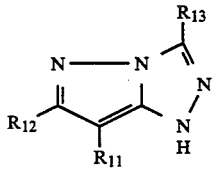

wherein $R_{12}$ and $R_{13}$ are each a hydrogen atom, an alkyl group, an alkylthio group, an aryl group, a heterocyclic group composed of 5 or 6 atoms, an amino group, an acylamino group, a hydroxyl group, an alkoxyl group, an alkoxycarbonyl group, an aryloxycarbonyl group, a carbamoyl group, a sulfamoyl group, or a sulfonamide group, and $R_{11}$ is as defined for the general formula (V).

Formula (VII)

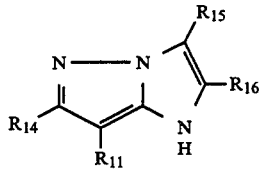

wherein $R_{14}$, $R_{15}$, and $R_{16}$ are each a hydrogen atom, an alkyl group, an aryl group, a heterocyclic group, a cyano group, an alkoxyl group, an aryloxy group, an acylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, or an alkoxycarbonyl group, and $R_{15}$ and $R_{16}$ may combine together to form a 5-, 6- or 7-membered ring except for an aromatic ring and further may be halogen atoms, and $R_{11}$ is as defined for the general formula (VI).

Formula (VIII)

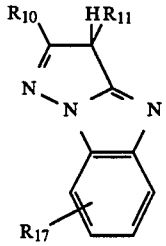

wherein $R_{10}$ and $R_{11}$ are as defined for the general formula (VI), and $R_{17}$ is a hydrogen atom, or contains 1 to 35 carbon atoms and preferably 1 to 22 carbon atoms and is a straight or branched alkyl group, an alkenyl group, a cyclic alkyl group, an aralkyl group, a cyclic alkenyl group, an aryl group, or a heterocyclic group.

Of the magenta couplers represented by the general formulas (V) to (VIII), the compounds represented by the general formula (V) produce especially great effects when used in combination with the compounds of the general formula (I).

Thus the general formula (V) is described below in greater detail.

The anilino group represented by $R_{10}$ in the general formula (V) includes a phenylamino group, an o-chlorophenylamino group, a 2,4-dichlorophenylamino group, a 2,4-dichloro-5-methoxyphenylamino group, a 2-chloro-5-tetradecaneamidophenylamino group, a 2-chloro-5-{α-(2,4-di-tert-amylphenoxy)butylamido}phenylamino group, a 2-chloro-5-{(α-(2,4-di-tert-amylphenoxy)butylamido}phenylamino group, a 2-chloro-5-{(3-octadecenyl)succinimido}phenylamino group, and a 2-chloro-5-[α-{(3-tert-butyl-4-hydroxy)phenoxy}tetradecaneamido]phenylamino group.

The acylamino group of $R_{10}$ includes an acetylamino group, a butylamide group, an α-(3-pentadecylphenoxy)butylamide group, a n-tetradecaneamide group, an α-(2,4-di-tert-amylphenoxy)butylamide group, a 3-{α-(2,4-di-tert-amylphenoxy)butylamide}benzamide group, a benzamide group, and a 3-acetylamidobenzamide group.

The ureido group of $R_{10}$ includes a phenylureido group, a methylureido group, and a 3-{α-(2,4-di-tert-amylphenoxy)butylamido}phenylureido group.

$X_1$, $X_2$ and $X_3$ are each a hydrogen atom, an alkyl group (e.g., a methyl group and an ethyl group), a halogen atom (e.g., a chlorine atom, a bromine atom, and a fluorine atom), an alkoxy group (e.g., a methoxy group and an ethoxy group), an aryloxy group (e.g., a phenyloxy group and a naphthyloxy group), an acylamino group (e.g., an acetylamino group and an α-(2,4-di-tert-amylphenoxy)butylamide group), a carbamoyl group (e.g., a methylcarbamoyl group and a phenylcarbamoyl group), a sulfamoyl group (e.g., a methylsulfamoyl group and a phenylsulfamoyl group), a sulfonyl group (e.g., an ethylsulfonyl group, a butylsulfonyl group, and a methylsulfonyl group), or a cyano group.

$R_{11}$ is a hydrogen atom or a group capable of being released through a coupling reaction with an oxidized aromatic primary amino color developer. This group includes a thiocyano group, a acyloxy group (e.g., an acetoxy group, a decanoyl group, an octadecanoyloxy group, a β-naphthoyloxy group, a 3-[γ-(2,4-di-tert-amylphenoxy)butylamido]benzoyloxy group, a 3-pentadecylphenoxy group, and a benzoyloxy group), an aryloxy group (e.g., a phenoxy group, a p-chlorophenoxy group, a p-nitrophenoxy group, and a naphthoxy group), an aralkyloxycarbonyl group (e.g., a benzyloxycarbonyl group), an alkyloxycarbonyloxy group (e.g., an ethyloxycarbonyloxy group), a halogen atom (e.g., chlorine and fluorine), a cycloalkoxy group (e.g., a cyclohexyloxy group), an aromatic amino group (e.g., a phthalimide group), and a heterocyclic amino group (e.g., a piperidino group).

Two or more of the couplers as described above can be incorporated in the same layer.

Useful examples of the magenta couplers are shown below, although the present invention is not limited thereto.

[A]

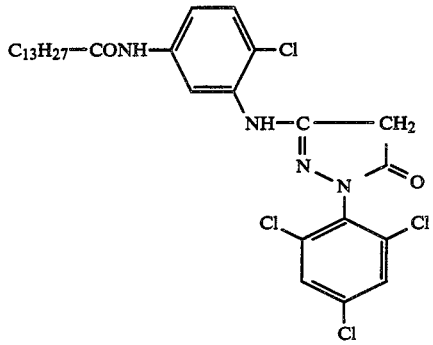

[B]

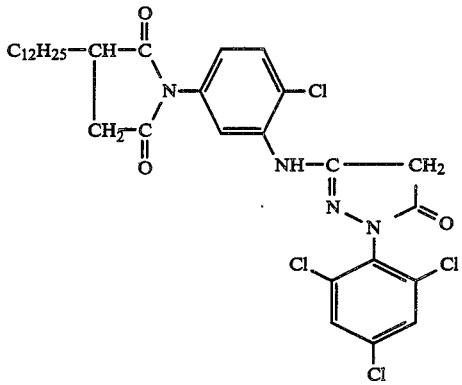

[C]

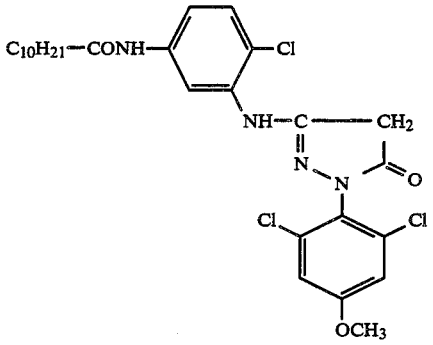

[D]

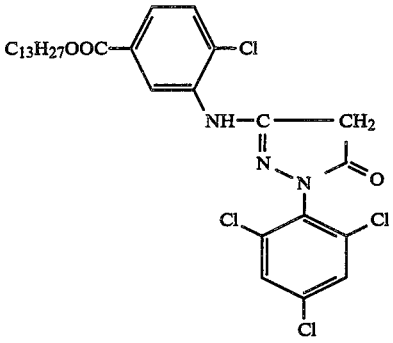

[E]

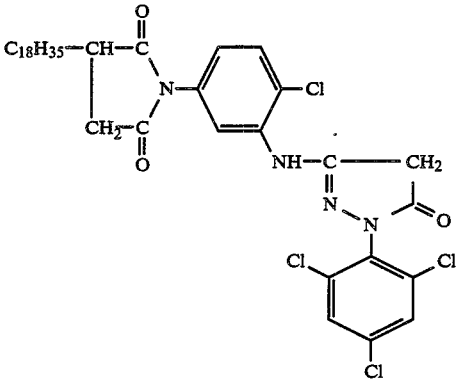

[F]

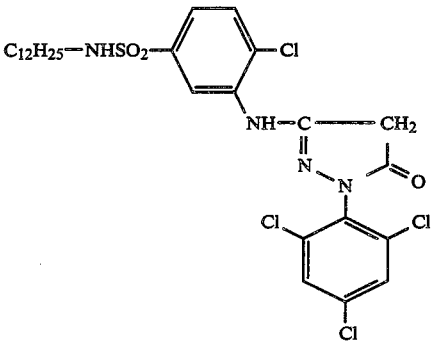

-continued
[G]
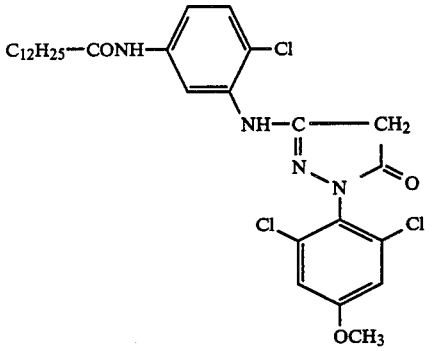
[H]
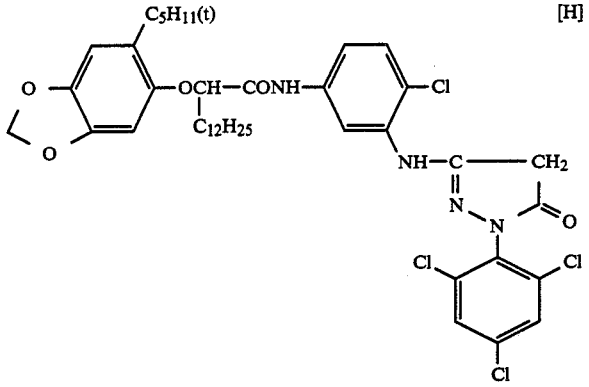
[I]
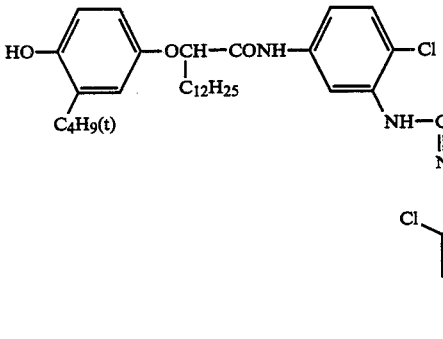
[J]
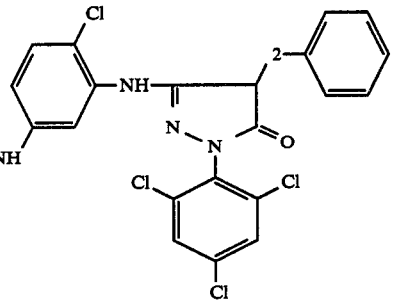
[K]
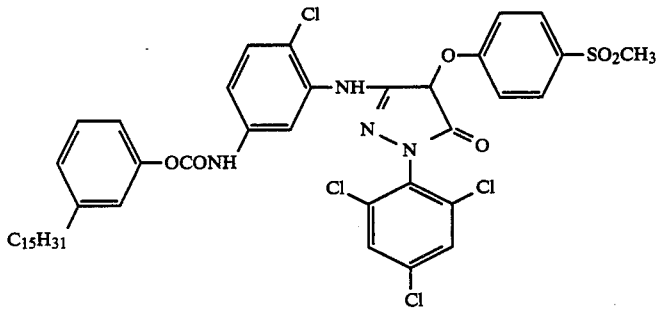
[L]
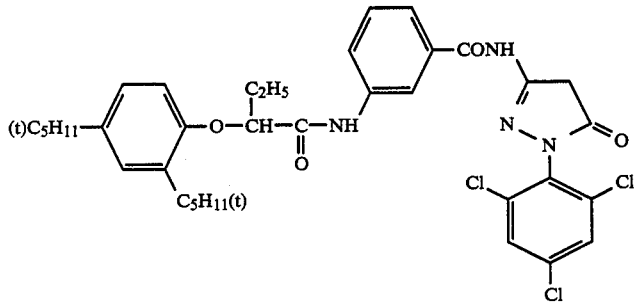

-continued

[M]

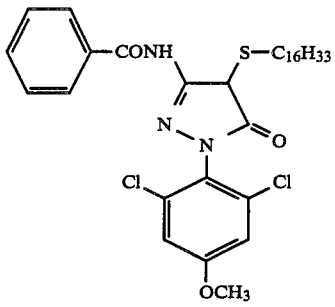

[N]

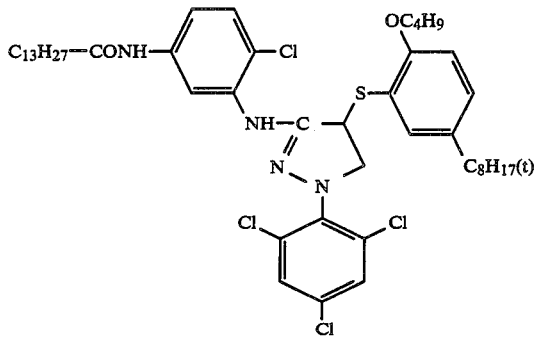

[O]

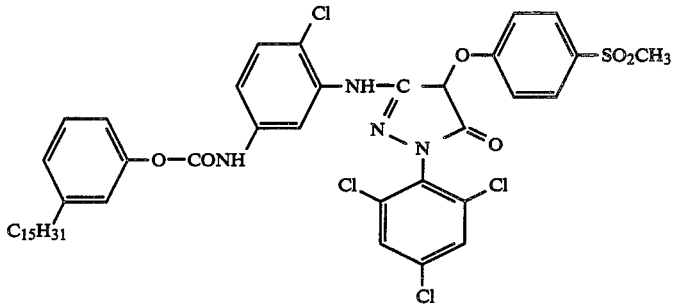

[P]

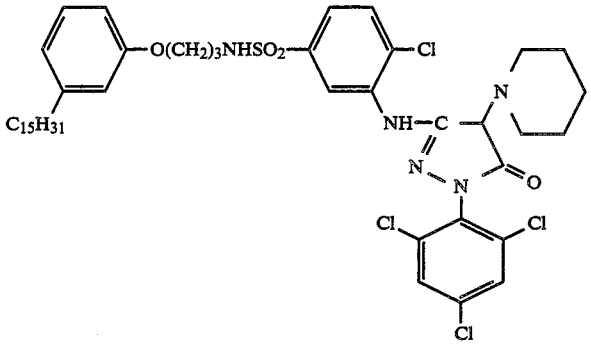

[Q]

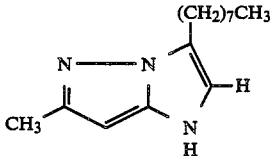

It would have not been possible to anticipate from the above-described references that the hydroquinones of the general formula (IV), when used in combination with the magenta couplers represented by the general formula (V), bring about considerably significant effects such as stabilization of dye images and prevention of color contamination of the white background.

In addition to the magenta couplers, the following couplers can be used in the present invention.

Yellow couplers:

Representative examples are described in, for example, U.S. Pat. Nos. 2,875,057, 3,265,506, 3,408,194, 3,551,155, 3,582,322, 3,725,072, 3,891,445, West German Pat. No. 1,547,868, West German Patent Application Laid-Open Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 8242/77, and 115219/77.

Cyan couplers:

Representative examples are described in, for example, U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77, and 90932/77.

Colored couplers:

Representative examples are described in, for example, U.S. Pat. No. 3,476,560, Japanese Patent Publication Nos. 2016/69, 22335/63, 11304/67, 32461/69, Japanese Patent Application (OPI) Nos. 26034/76, 42121/77, and West German Patent Application (OLS) No. 2,418,959.

DIR couplers:

Representative examples are described in, for example, U.S. Pat. Nos. 3,227,554, 3,617,291, 3,701,783, 3,790,384, 3,632,345, West German Patent Application (OLS) Nos. 2,414,006, 2,454,301, 2,454,329, British Pat. No. 953,454, Japanese Patent Application (OPI) Nos. 69624/77, 122335/74, and Japanese Patent Publication No. 16141/76.

In addition to DIR couplers, compounds releasing a development inhibitor as the development process proceeds can be incorporated in the light-sensitive material. For example, the compounds described in U.S. Pat. Nos. 3,297,445, 3,379,529, West German Patent Application (OLS) No. 2,417,914, Japanese Patent Application (OPI) Nos. 15271/77 and 9116/78 can be used.

Two or more of the above-described couplers can be incorporated in the same layer.

In the practice of the present invention, known antifading agents can be used in combination. The compounds of the invention, which are used as color image stabilizers, can be used singly or in combination with each other.

The known antifading agents include hydroquinone derivatives, gallic acid derivatives, p-alkoxyphenols, p-oxyphenol derivatives, and bisphenols.

Representative examples of the hydroquinone derivatives are described in, for example, U.S. Pat. Nos. 2,360,290, 2,418,613, 2,675,314, 2,701,197, 2,704,713, 2,728,659, 2,732,300, 2,735,765, 2,710,801, 2,816,028, and British Pat. No. 1,363,921. Representative examples of the gallic acid derivatives are described in, for example, U.S. Pat. Nos. 3,457,079 and 3,069,262. Representative examples of the p-alkoxyphenols are described in, for example, U.S. Pat. Nos. 2,735,765, 3,698,909, Japanese Patent Publication No. 20977/74, and 6623/77. Representative examples of the p-oxyphenol derivatives are described in, for example, U.S. Pat. Nos. 3,432,300, 3,573,050, 3,574,627, 3,764,337, Japanese Patent Application (OPI) Nos. 35633/77, 147434/77, and 152225/77. Representative examples of the bisphenols are described in, for example, U.S. Pat. No. 3,700,455.

The couplers can be introduced in the silver halide emulsion layers by known techniques such as the method described in U.S. Pat. No. 2,322,027. For example, the coupler is dissolved in phthalic acid alkyl esters (e.g., dibutyl phthalate and dioctyl phthalate), phosphoric acid esters (e.g., diphenyl phosphate, triphenyl phosphate, tricresyl phosphate, and dioctylbutyl phosphate), citric acid esters (e.g., tributyl acetylcitrate), benzoic acid esters (e.g., octyl benzoate), alkylamides (e.g., diethyllaurylamide), fatty acid esters (e.g., dibutoxyethyl succinate and dioctyl azelate), trimesinic acid esters e.g., tributyl trimesinate), etc., or organic solvents having a boiling point ranging between about 30° and 150° C., such as lower alkyl acetates (e.g., ethyl acetate and butyl acetate), ethyl propionate, sec-butyl alcohol, methyl isobutyl ketone, $\beta$-ethoxyethyl acetate, and methylcellosolve acetate, and then dispersed in hydrophilic colloid. The above-described high-boiling and low boiling organic solvents can be used in combination with each other.

The compound of the general formula (I) is incorporated into photographic layers in the same way as in the above method which is commonly used for an incorporation of couplers into emulsion layers.

In the light-sensitive material of the present invention containing the compound of the general formula (I), its photographic emulsion layers or other hydrophilic colloid layers may contain various surfactants for various purposes, such as as coating aids, or for the purpose of preventing charging, improving sliding properties, facilitating emulsification and dispersion, preventing adhesion, or of improving photographic characteristics (e.g., acceleration of development, increasing contrast, and sensitization).

Surfactants which can be used include:

nonionic surfactants, such as saponin (steroid), alkylene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or amides, and silicone/polyethylene oxide adducts), glycidol derivatives (e.g., alkenylsuccinic acid polyglyceride and alkylphenol polyglyceride), polyhydric alcohol fatty acid esters, and alkyls of sugar:

anionic surfactants containing acid groups, such as a carboxyl group, a sulfo group, a phospho group, a sulfate group, and a phosphate group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphoric acid esters;

amphoteric surfactants, such as amino acids, amino alkylsulfonic acids, aminoalkylsulfuric acid esters or phosphoric acid esters, alkylbetaines, and amineoxides; and cationic surfactants, such as alkylamine salts, aliphatic or aromatic quaternary ammonium salts, heterocyclic quaternary ammonium salts (e.g., pyridinium and imidazolium), and aliphatic or heterocyclic ring-containing phosphonium or sulfonium salts.

Photographic silver halide emulsions used in the present invention can be prepared by processes described in P. Glafkides, *Chimie et Physique Photographique* (published by Paul Montel Co., 1967), G. F. Duffin, *Photographic Emulsion Chemistry* (published by The Focal Press, 1966, and V. L. Zelikman et al., *Making and Coating Photographic Emulsion* (published by The Focal Press, 1964), etc. Namely, they may be prepared by any acid process, neutral process or ammonia process. Further, the reaction of soluble silver salts with soluble halogen salts may be carried out by any one-side mixing process, simultaneous mixing process or combination thereof.

It is also possible to use a process for forming grains in a presence of an excess amount of silver ions (the so-called reverse mixing process). It is possible to use a simultaneous mixing process in which the pAg of the liquid phase for forming silver halide is kept at a fixed value, namely, the so-called controlled double jet process.

According to this process, silver halide emulsions having a regualr crystal form and a nearly uniform particle size can be obtained.

Two or more silver halide emulsions prepared separately may be blended and used in connection with the present invention.

The light-sensitive material of the present invention may contain ultraviolet absorbers in hydrophilic colloid layers thereof. Ultraviolet absorbers which can be used include any aryl group-substituted benzotriazole compounds, 4-thiazolidone compounds, benzophenone compounds, cinnamic acid ester compounds, butadiene compounds, and benzoxazole compounds. In addition, ultraviolet ray-absorbing polymers can be used. These ultraviolet absorbers may be fixed in the above-described hydrophilic colloid layer.

In photographic processing of the light-sensitive material of the present invention, color photographic processing agents such as color developers, bleaching agents and stabilizers which are commonly used can be used, and any known color processing procedure can be applied. In addition, color intensification as described in West German Patent Application (OLS) No. 181,390, Japanese Patent Application (OPI) No. 9728/73, and Japanese Patent Application No. 128327/74 can be utilized in the present invention.

With regard to photographic silver halide emulsions and their methods of preparation, photographic additives (or photographic materials), etc. which can be used in the light-sensitive material of the present invention, reference can be made to *Research Disclosure,* No. 176 (November 1978), Clauses 22–31, "Preparation and Type of Emulsion", "Rinsing of Emulsion", "Chemical Sensitization", "Antifoggants and Stabilizers", "Hardners", "Support", "Plasticizers and Lubricants", "Coating Aids", "Matting Agents", "Sensitizers", "Spectral Sensitizers", "Method of Addition", "Absorption and Filter Dye", and "Coating Method".

The present invention is described in greater detail with reference to the following examples.

EXAMPLE 1

Ten grams of a magenta coupler, 1-(2,4,6-trichlorophenyl)-3-{(2-chloro-5-tetradecanamido)anilino}-2-pyrazoline-5-one (Compound A), was dissolved in 20 ml of tricresyl phosphate and 20 ml of ethyl acetate. The thus-prepared solution was dispersed in 80 g of a 10% gelatin solution containing 8 ml of a 1% aqueous solution of sodium dodecylbenzenesulfonate.

The above-prepared dispersion was mixed with 145 g of a green-sensitive silver chlorobromide emulsion (Br: 50 mol%; Ag content: 7 g), and sodium dodecylbenzenesulfonate was added thereto as a coating aid. The resulting mixture was coated on a paper support, both sides of which had been laminated with polyethylene. This light-sensitive material is called "Sample A". The amount of the coupler coated was 400 mg/m$^2$.

Light-sensitive materials, Samples B to H, were prepared in the same manner as in the preparation of Sample A except that in preparing the dispersion, 3 g of each of the compounds of the present invention and comparative compounds as shown in Table 1 was added.

Each light-sensitive material was exposed to light at 1,000 lux for 1 second and, thereafter, treated as follows:

| | Temperature (°C.) | Time (min) |
|---|---|---|
| Development | 33 | 3.5 |
| Bleach-Fixing | 33 | 1.5 |
| Rinsing | 28–35 | 3 |
| Developer | | |
| Benzyl alcohol | | 15 ml |
| Diethylenetriaminetetraacetic acid | | 5 g |
| KBr | | 0.4 g |
| $Na_2SO_3$ | | 5 g |
| $Na_2CO_3$ | | 30 g |
| Hydroxylaminesulfuric acid salt | | 2 g |
| 4-Amino-3-methyl-N—β-(methanesulfonamido)ethylaniline. 3/2 $H_2SO_4.H_2O$ | | 4.5 g |
| Water to make | | 1,000 ml |
| | (pH: 10.1) | |
| Bleach-Fixing Solution | | |
| Ammonium thiosulfate (70 wt %) | | 150 ml |
| $Na_2SO_3$ | | 5 g |
| Na[Fe(EDTA)] | | 40 g |
| EDTA | | 4 g |
| Water to make | | 1,000 ml |
| | (pH: 6.8) | |

Each light-sensitive material with a dye image formed therein was subjected to a fade testing using a xenon tester (illumination: 200,000 lux) equipped with an ultraviolet ray-absorbing filter cutting wavelengths of not more than 400 nm (manufactured by Fuji Photo Film Co., Ltd.) for 3 days. This measurement was performed by the use of a Macbeth densitometer, Model RD-514 (Status AA filter), and the change in density of an area with an initial density of 1.0 was measured.

The results are shown in Table 1.

It can be seen from Table 1 that the compounds of the present invention prevent efficiently color images from fading and that the effect is ascribable to the presence of an aryl group linked through a methylene chain of suitable length to an alkyl group of the hydroquinone nucleus.

TABLE 1

| Sample | Color Image Stabilizer | Change in Magenta Density (Initial Denisty: 1.0) | Remarks |
|---|---|---|---|
| A | — | −0.73 | Comparaive example |
| B | Compound (1) | −0.10 | Example of the invention |
| C | Compound (5) | −0.16 | Example of the invention |
| D | Compound (9) | −0.20 | Example of the invention |
| E | Compound (10) | −0.09 | Example of the invention |
| F | Compound (11) | −0.11 | Example of the invention |
| G | Comparative Compound (a)*1 | −0.31 | Comparative example |
| H | Comparative Compound (b)*2 | −0.52 | Comparative example |

*1Compound (a) described in Japanese Patent Publication No. 33573/72 corresponding to U.S. Pat. No. 3,935,016

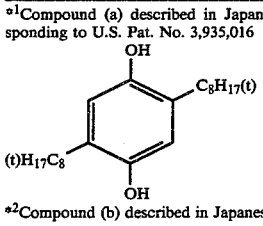

*2Compound (b) described in Japanese Patent Publication No. 40816/81.

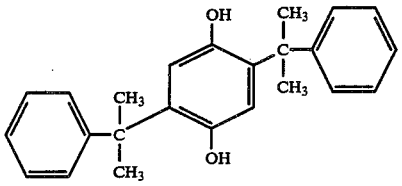

EXAMPLE 2

A multi-layer light-sensitive material having the structure and layer formulations shown in Table 2 was prepared. This material is called "Sample F".

In addition, light-sensitive materials of the same structure as in Sample F were prepared wherein in the preparation of the third layer Compound (1) of the present invention was added in an amount of 1.5 g or 3 g per 10 g of the coupler. These materials are called "Sample G" and "Sample H", respectively.

Furthermore, as comparative samples, light-sensitive materials of the same structure as in Sample F were prepared wherein in the preparation of the third layer Comparative Compound (a) was used in the amounts shown in Table 3. These light-sensitive materials are called "Sample I" and "Sample J".

Each light-sensitive material was exposed to light and processed in the same manner as in Example 1, and the dye image was tested for 3 weeks by the use of a fluorescent fading tester (20,000 lux).

The results are shown in Table 3.

TABLE 2

| | |
|---|---|
| Sixth Layer (Protective Layer) | |
| Gelatin | 1,000 mg/m$^2$ |
| Fifth Layer (Red-Sensitive Layer) | |
| Silver chlorobromide emulsion (Br: 50 mol %) | 300 mg/m$^2$ (calculated as silver) |
| Gelatin | 1,000 mg/m$^2$ |
| Cyan coupler*1 | 400 mg/m$^2$ |
| Coupler solvent*2 | 200 mg/m$^2$ |
| Fourth Layer (Intermediate Layer) | |
| Gelatin | 1,200 mg/m$^2$ |
| Ultraviolet absorber*3 | 1,000 mg/m$^2$ |
| Ultraviolet absorber solvent*2 | 250 mg/m$^2$ |
| Third Layer (Green-Sensitive Layer) | |
| Silver chlorobromide emulsion (Br: 50 mol % | 290 mg/m$^2$ (calculated as silver) |
| Gelatin | 1,000 mg/m$^2$ |
| Magenta coupler*4 | 200 mg/m$^2$ |
| Magenta coupler solvent*5 | 200 mg/m$^2$ |
| Second Layer (Intermediate Layer) | |
| Gelatin | 1,000 mg/m$^2$ |
| First Layer (Blue-Sensitive Layer) | |
| Silver chlorobromide emulsion (Br: 80 mol %) | 400 mg/m$^2$ (calculated as silver) |
| Gelatin | 1,200 mg/m$^2$ |
| Yellow coupler*6 | 300 mg/m$^2$ |
| Coupler solvent*7 | 150 mg/m$^2$ |
| Support | |
| Paper support laminated with polyethylene on both surfaces thereof. | |

*1Coupler: 2-[α-(2,4-Di-tert-pentylphenoxy)butaneamido-4,6-dichloro-5-methylphenol
*2Solvent: Dibutyl phthalate
*3Ultraviolet absorber: 2-(2-Hydroxy-3-sec-butyl-5-tert-butylphenyl)benzotriazole
*4Coupler: 3-[3-(3-Pentadecylphenoxy)propyl]-6-methyl-7-chloro-1H—pyrazolo[3,2-C]-s-triazole
*5Solvent: Tricresyl phosphate
*6Coupler: α-Pivaroyl-α-(2,4-dioxo-5,5'-dimethyloxazolidine-3-yl)-2-chloro-5-[α-(2,4-di-tert-pentyl-phenoxy)butaneamido]acetoanilide
*7Solvent: Dioctylbutyl phosphate

TABLE 3

| Sample | Color Image Stabilizer | Amount (per 10 g coupler) | Change in Magenta Density (Initial Density: 1.0) | Remarks |
|---|---|---|---|---|
| F | — | — | −0.65 | Control example |
| G | Compound (1) | 1.5 g | −0.26 | Example of the invention |
| H | Compound (1) | 3 g | −0.11 | Example of the invention |
| I | Comparative Compound (a) | 1.5 g | −0.48 | Comparative example |
| J | Comparative Compound (a) | 3 g | −0.32 | Comparative example |

It can be seen from Table 3 that the compound of the present invention is effective in the prevention of fading of magenta images, and that the effect increases as the amount of the compound added is increased.

While the invention has been described in detail and with reference to specific embodiments thereof, it will be apparent to one skilled in the art that various changes and modifications can be made therein without departing from the spirit and scope thereof.

What is claimed is:

1. A color photographic silver halide light-sensitive material characterized by containing at least one compound selected from the group consisting of a hydroquinone compound represented by the general formula (I) and precursors thereof.

Formula (I)

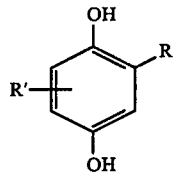

wherein R represents

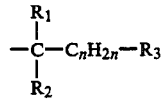

(wherein $R_1$ and $R_2$ are each a hydrogen atom or an alkyl group and may combine with $R_3$ to form a ring having 5 to 10 carbon atoms, provided that $R_1$ and $R_2$ are not hydrogen atoms at the same time, and $R_3$ is a substituted or unsubstituted aryl group, and n is an integer of 1 to 4), and R' has 1 to 20 carbon atoms and represents a substituted or unsubstituted alkyl group, a substituted or unsubstituted cycloalkyl group, a substituted or unsubstituted aryl group, or R.

2. A light-sensitive material as claimed in claim 1, wherein the hydroquinone compound is a compound represented by the general formula (II) or its precursor Formula (II)

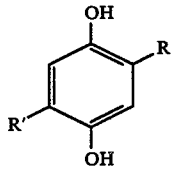

wherein R represents

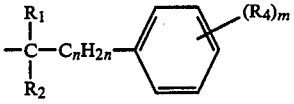

R', $R_1$ and $R_2$ are as defined in claim 1, $R_4$ is a hydrogen atom, or an alkyl group, an aryl group, an alkyloxy group, an aryloxy group, a carbamoyl group, an acylamino group, an acyl group, a carbonyloxy group, a sulfamoyl group, a sulfonyl group, a sulfonylamino group, an alkoxycarbonyl group, the groups having up to 8 carbon atoms, a hydroxyl group, a halogen atom, or a cyano group, m is an integer of 1 to 4, and when m is not less than 2, $R_4$ is the same or different, and n is an integer of 1 to 4.

3. A light-sensitive material as claimed in claim 1, further comprising a magenta coupler compound represented by the general formulas (V), (VI), (VII) and (VIII) in a silver halide emulsion of the material;

Formula (V)

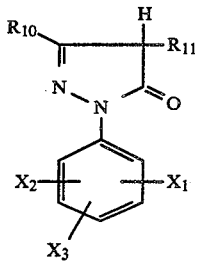

wherein $R_{10}$ is an anilino group, an acylamino group, or a ureido group, $X_1$, $X_2$ and $X_3$ are each a hydrogen atom, an alkyl group, a halogen atom, an alkoxy group, an aryloxy group, an acylamino group, a carbamoyl group, a sulfamoyl group, a sulfonyl group, or a cyano group, and may be the same or different, and $R_{11}$ is a hydrogen atom or a group capable of being released through a coupling reaction with an oxidized aromatic primary amino color developing agent;

Formula (VI)

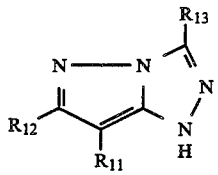

wherein $R_{12}$ and $R_{13}$ are each a hydrogen atom, an alkyl group, an alkylthio group, an aryl group, a heterocyclic ring composed of 5 or 6 atoms, an amino group, an acylamino group, a hydroxyl group, an alkoxyl group, an alkoxycarbonyl group, an aryloxycarbonyl group, a carbamoyl group, a sulfamoyl group, or a sulfonamide group, and $R_{11}$ is as defined in the general formula (V);

Formula (VII)

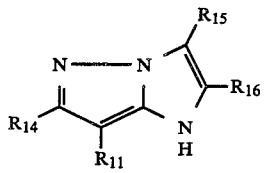

wherein $R_{14}$, $R_{15}$ and $R_{16}$ are each a hydrogen atom, an alkyl group, an aryl group, a heterocyclic group, a cyano group, an alkoxyl group, an aryloxy group, an acylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, or an alkoxycarbonyl group, $R_{11}$ is as defined in the general formula (VI), and $R_{15}$ and $R_{16}$ may combine together to form a 5-, 6- or 7-membered ring except for an aromatic ring and may be halogen atoms, Formula (VIII)

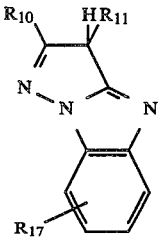

wherein $R_{10}$ and $R_{11}$ are as defined in the general formula (v), and $R_{17}$ is a hydrogen atom, or a straight or branched alkyl group, an alkenyl group, a cyclo alkyl group, an aralkyl group, a cyclic alkenyl group, an aryl group, or a heterocyclic group.

4. A light-sensitive material as claimed in claim 3, wherein the magenta coupler is represented by the general formula (V).

5. A color photographic silver halide light-sensitive material, comprising:

a support base having provided thereon;

a silver halide emulsion layer containing therein;

a magenta coupler represented by the general formula (V):

Formula (V)

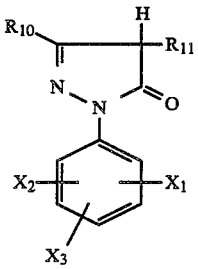

wherein $R_{10}$ is an anilino group, an acylamino group or a ureido group, $X_1$, $X_2$ and $X_3$ are each a hydrogen atom, an alkyl group, a halogen atom, an alkoxyl group, an aryloxy group, an acylamino group, a carbamoyl group, a sulfamoyl group, a sulfonyl group, or a cyano group, and may be the same or different, and $R_{11}$ is a hydrogen atom or a group capable of being released through a coupling reaction with an oxidized aromatic primary amino color developing agent; and a hydroquinone compound represented by the general formula (I) and precursors thereof:

Formula (I)

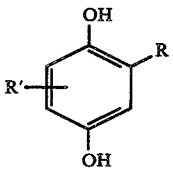

wherein R represents

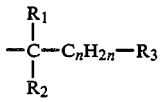

(wherein $R_1$ and $R_2$ are each a hydrogen atom or an alkyl group and may combine with $R_3$ to form a ring having 5 to 10 carbon atoms, provided that $R_1$ and $R_2$ are not hydrogen atoms at the same time, and $R_3$ is a substituted or unsubstituted aryl group, and n is an integer of 1 to 4), and R' has 1 to 20 carbon atoms and represents a substituted or unsubstituted alkyl group, a substituted or unsubstituted cycloalkyl group, a substituted or unsubstituted aryl group, or R.

6. A light-sensitive material as claimed in claim 3, wherein said coupler is contained in the emulsion layer in an amount of $2\times10^{-3}$ to $5\times10^{-1}$ mole per mole of silver halide.

7. A light-sensitive material as claimed in claim 6, wherein said coupler is contained in an amount of $1\times10^{-2}$ to $5\times10^{-1}$ mole per mole of silver halide.

8. A light-sensitive material as claimed in claim 3, wherein said compound selected from the group consisting of a hydroquinone compound represented by general formula (I) and precursors thereof is contained in an amount of 0.5 to 200 wt.% based on the weight of the coupler.

9. A light-sensitive material as claimed in claim 8, wherein said compound is contained in an amount of 2 to 150 wt.% based on the weight of the coupler.

10. A light-sensitive material as claimed in claim 1, wherein said compound is added in an amount of $1\times10^{-5}$ to 1 mole per mole of silver halide.

11. A light-sensitive material as claimed in claim 10, wherein said compound is added in an amount of $1\times10^{-3}$ to $5\times10^{-1}$ mole per mole of silver halide.

12. A light-sensitive material as claimed in claim 1, wherein the hydroquinone compound is a compound represented by the general formula (III) or its precursor:

Formula (III)

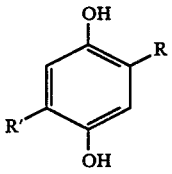

wherein R represents

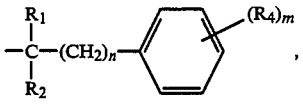

R' is as defined in claim 1, $R_4$ is a hydrogen atom, or an alkyl group, an aryl group, an alkyloxy group, an aryloxy group, a carbamoyl group, an acylamino group, an acyl group, a carbonyloxy group, a sulfamoyl group, a sulfonyl group, a sulfonylamino group, an alkoxycarbonyl group, the groups having up to 8 carbon atoms, a hydroxyl group, a halogen atom, or a cyano group, m is an integer of 1 to 4, and when m is not less than 2, $R_4$ is the same or different, $R_1$ and $R_2$ are each an alkyl group or a group capable of forming a ring by a combination with the group

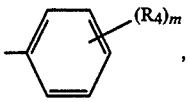

and n is an integer of 1 to 4.

13. A light-sensitive material as claimed in claim 1, wherein the hydroquinone compound is an compound represented by the general formula (IV) or its precursor:

Formula (IV)

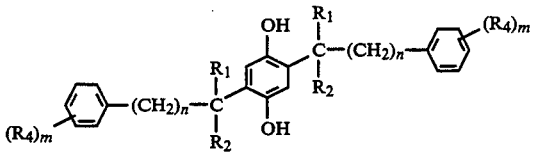

wherein $R_1$ and $R_2$ are each an alkyl group or a group capable of forming a ring by a combination with the group

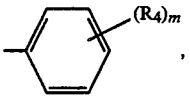

$R_4$ is a hydrogen atom, or an alkyl group, an aryl group, an alkyloxy group, an aryloxy group, a carbamoyl group, an acylamino group, an acyl group, a carbonyloxy group, a sulfamoyl group, a sulfonyl group, a sulfonylamino group, an alkoxycarbonyl group, the groups having up to 8 carbon atoms, a hydroxyl group, a halogen atom, or a cyano group, m is an integer of 1 to 4, and when m is not less than 2, $R_4$ is the same or different, and n is 2 or 3.

14. A light-sensitive material as claimed in claim 4, wherein the hydroquinone compound is a compound represented by the general formula (IV) or its precursor:

Formula (IV)

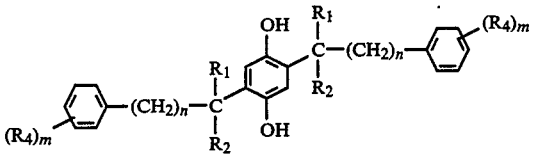

wherein $R_1$ and $R_2$ are each an alkyl group or a group capable of forming a ring by a combination with the group

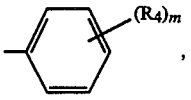

$R_4$ is a hydrogen atom, or an alkyl group, an aryl group, an alkyloxy group, an aryloxy group, a carbamoyl group, an acylamino group, a acyl group, a carbonyloxy group, a sulfamoyl group, a sulfonyl group group, a sulfonylamino group, an alkoxycarbonyl group, the groups having up to 8 carbon atoms, a hydroxyl group, a halogen atom, or a cyano group, m is an integer of 1 to 4, and when m is not less than 2, $R_4$ is the same or different, and n is 2 or 3.

* * * * *